US011083271B2

(12) United States Patent
Akyurt

(10) Patent No.: US 11,083,271 B2
(45) Date of Patent: Aug. 10, 2021

(54) HAIRCUTTING AID

(71) Applicant: Ali Sinan Akyurt, Brooklyn, NY (US)

(72) Inventor: Ali Sinan Akyurt, Brooklyn, NY (US)

( * ) Notice: Subject to any disclaimer, the term of this patent is extended or adjusted under 35 U.S.C. 154(b) by 164 days.

(21) Appl. No.: 15/990,603

(22) Filed: May 26, 2018

(65) Prior Publication Data

US 2019/0357655 A1 Nov. 28, 2019

(51) Int. Cl.
*A45D 24/04* (2006.01)

(52) U.S. Cl.
CPC ..... *A45D 24/04* (2013.01)

(58) Field of Classification Search
CPC ..... A45D 24/04; A45D 24/38; A45D 24/36; A45D 24/14; A45D 24/10; A45D 24/44; A45D 24/00; A45D 2/44; A45D 2/42; A45D 2/002; A01K 13/00; A01K 13/002
USPC ..... 132/126, 129, 144, 145, 213, 214, 219, 132/11, 213.1, 139, 142, 212, 271, 133, 132/131, 150, 200, 149; D28/21; 30/124
See application file for complete search history.

(56) References Cited

U.S. PATENT DOCUMENTS 181,904 A * 9/1876 Williams ..... A45D 24/02 132/141
1,286,823 A * 12/1918 Stable ..... A45D 24/36 132/213.1
1,359,343 A * 11/1920 Dodge ..... A45D 24/36 132/124
2,150,260 A * 3/1939 Yates ..... A45D 24/14 132/149
2,154,336 A * 4/1939 Newton ..... A45D 24/14 132/139
4,008,726 A * 2/1977 DiGiuseppe ..... A45D 2/44 132/136
5,365,952 A * 11/1994 Noble ..... A45D 24/36 132/129
5,659,957 A * 8/1997 Fujita ..... B26B 19/20 30/124
2007/0193598 A1* 8/2007 Pallardy ..... A45D 24/04 132/200
2014/0251358 A1* 9/2014 Temple ..... A45D 24/04 132/149

(Continued)

FOREIGN PATENT DOCUMENTS

CN 204273556 U * 4/2015 ..... A45D 24/02
FR 2385355 A1 * 10/1978 ..... A45D 24/36

OTHER PUBLICATIONS

Milady, Milady's Standard Cosmetology Textbook, 2012, Cengage Learning, 1st edition, 376-380 (Year: 2012).*

*Primary Examiner* — Jacqueline T Johanas
*Assistant Examiner* — Sarah Woodhouse

(57) ABSTRACT

A haircutting aid adapted to measure a predetermined length and inclination of hair and firmly hold the specific measured portion of hair for precise haircut, is disclosed. The haircutting aid comprises a handle member, at least two stationary combs disposed at a proximal end of the handle member, at least one movable comb disposed parallel to at least one stationary comb, at a distal end of the handle member, and a thumb hole disposed at the handle member to manipulate the at least one movable comb relative to the at least one stationary comb, to allow to engage and measure the length and inclination of a hair need to be cut. Further, a switch is disposed at the handle member to lock the movable comb on engaging the length of hair.

2 Claims, 4 Drawing Sheets

(56) References Cited

U.S. PATENT DOCUMENTS

2014/0366908 A1* 12/2014 Shevlin ..... A45D 24/04
132/210

* cited by examiner

HAIRCUTTING AID

BACKGROUND OF THE INVENTION

A typical known comb includes a body defining a handle and a plurality of teeth projecting from the handle. The teeth are rigid and formed integrally with the handle. Since the comb and its teeth are typically rigid, each comb has a predetermined fineness, or spacing between its teeth. A person could own several combs in order to have access to combs having different finenesses. In the profession of barbering, certain hair cutting techniques such as texturizing and creation of certain hair styles require a frequent change of comb of different finesnesses. This would create significant stress on parts of the hand and wrist of the individual or barber.

Further, most hair styles include curved configuration, conventional straight comb must be manipulated back and forth a great many times during the cutting operation, thereby needlessly consuming unnecessary time and effort. Thus, conventional combing device would be only beneficial in the combing process and does not aid in haircutting.

Existing hair styling or cutting devices are composed of a razor with stem handle which is held by a stylist or barber between the thumb and forefinger and does not allow the stylist to maintain pressure accurately and evenly across the shafts of the hair. This could cause a miscalculation of the length and therefore provide inaccurate results.

Therefore, there is a need for a haircutting aid that allows a user to measure the length and inclination before initiating the haircutting process in order to give a precise haircut. Further, there is a need for a haircutting aid that allows the user to reset the length and inclination during haircut, if necessary. Further, there is need for a haircutting aid that measures a predetermined length and inclination of hair and firmly holds the specific measured portion of hair for precise haircut. Further, there is a need for a haircutting aid that allows any person or stylist to execute a perfect haircut without applying a haircut technique that need to be developed by many years of practice and experience.

SUMMARY OF THE INVENTION

The present invention discloses a haircutting aid adapted to measure a predetermined length and inclination of hair and firmly hold the specific measured portion of hair for precise haircut. The haircutting aid is configured to allow a user to execute a perfect haircut without requiring a haircut technique developed with many years of practice and experience. The haircutting aid is further configured to allow the user to set a predetermined length and inclination before starting the haircutting process to give a precise haircut. The haircutting aid further configured to allow the user to reset the set length and inclination during haircut, if necessary.

According to the present invention, the haircutting aid comprises a handle member, and a comb assembly. The comb assembly includes at least three combs that are connected to one another in different position. The handle member includes a first end and a second end spaced from the first end. The comb assembly is secured at the handle member.

The comb assembly comprises a first comb fixedly disposed at the second end of the handle member including a first elongated body and a plurality of first teeth projecting from the first elongated body in a common direction. The comb assembly further comprises a second comb movably disposed at the first end of the handle member including a second elongated body and a plurality of second teeth projecting from the second elongated body in the common direction. The second comb is disposed parallel to the first comb. The comb assembly further comprises a third comb disposed at rear perpendicular to the first elongated body, including a plurality of third teeth projecting therefrom.

In one embodiment, the handle member is an elongate rectangular member. A transverse aperture is disposed there along a length of the handle member for receiving user's finger. A control member extends from the handle member, at a region proximal to the second end. In one embodiment, the control member is a finger hole for receiving a thumb of the user. The finger hole is configured to engage and measure a predetermined length of hair. A switch is disposed at the handle member to lock the second comb on engaging the predetermined length and inclination of hair. In one embodiment, the finger hole is configured to move inwards or towards the user holding the aid for selective movement of the second comb. In one embodiment, the finger hole is configured to move outwards or away from the user holding the aid to resume an initial position of the second comb.

In one embodiment, a method of using the haircutting aid is disclosed. At one step, the haircutting aid is provided, which comprises a handle member to hold the haircutting aid, at least two stationary combs disposed at a proximal end of the handle member, at least one movable comb disposed parallel to at least one stationary comb, at a distal end of the handle member, a thumb hole disposed at the handle member to manipulate the at least one movable comb relative to the at least one stationary comb, to allow to engage and measure the length of a hair, and a switch to lock the movable comb on engaging the predetermined length and/or inclination of the hair that needs to be cut.

At another step, the haircutting aid is held against a hair surface of the user via the handle member. At another step, the thumb hole is manipulated inward to move the at least one movable comb relative to the at least one stationary comb to engage a predetermined length and/or inclination of the hair need to be cut. At another step, the at least one movable comb on engaging a predetermined length and/or inclination of the hair is locked.

At another step, the length of the half engaged between at one movable comb and the at least one stationary comb. At another step, the set length or inclination could be adjusted during haircut, if necessary.

One aspect of the present disclosure is directed to a haircutting aid, comprising (a) an elongated handle member, the elongated handle member including a first end and a second end spaced from the first end; and (b) a comb assembly secured to the elongated handle member thereof, comprising (i) a first comb fixedly disposed at the second end of the handle member including a first elongated body and a plurality of first teeth projecting from the first elongated body in a common direction, (ii) a second comb movably disposed at the first end of the handle member including a second elongated body and a plurality of second teeth projecting from the second elongated body in the common direction, said second comb is disposed parallel to the first comb, and (iii) a third comb disposed rear perpendicular to the first elongated body including a plurality of third teeth projecting in a common direction, and (c) a control member extending proximal to the second end of the handle for selective movement of the second comb relative to the first comb to engage and measure a predetermined length and inclination of hair.

In one embodiment, the handle member comprises a switch to lock the second comb on engaging the length of the hair. In another embodiment, the handle member comprises a transverse aperture along a length of the handle member for receiving user's fingers. In one embodiment, the control member is a finger hole for receiving a thumb of the user. In another embodiment, the control member is moved inwards for selective movement of the second comb. In one embodiment, the control member is moved outwards to resume to an initial position of the second comb.

Another aspect of the present disclosure is directed to a haircutting aid, comprising: (a) a handle member; (b) at least two stationary combs disposed at a proximal end of the handle member; (c) at least one movable comb disposed parallel to at least one stationary comb, at a distal end of the handle member, and (d) a control member disposed at the handle member to manipulate the at least one movable comb relative to the at least one stationary comb to engage and measure a predetermined length and inclination of hair. In one embodiment of this aspect, the handle member comprises a switch to lock the at least one movable comb on engaging the hair. In one embodiment of this aspect, the handle member comprises a transverse aperture along a length of the handle member for receiving user's fingers. In one embodiment of this aspect, the control member is a finger hole for receiving a thumb of the user. In one embodiment, the control member is moved inwards for selective movement of the at least one movable comb. In another embodiment of this aspect, the finger hole is moved outwards to resume to an initial position of the at least one movable comb.

Another aspect of the present disclosure is directed to a method of using a haircutting aid, comprising the step of: (a) providing the haircutting aid comprising a handle member, at least two stationary combs disposed at a proximal end of the handle member, at least one movable comb disposed parallel to at least one stationary comb, at a distal end of the handle member, a thumb hole disposed at the handle member to manipulate the at least one movable comb relative to the at least one stationary comb, to allow the user to engage and measure a predetermined length and inclination of hair, and a switch to lock the movable comb on engaging the measured portion of hair; (b) holding the haircutting aid against hair surface of a user; (c) manipulating the thumb hole inward to move the at one movable comb relative to the at least one stationary comb to engage a length and inclination of the hair that need to be cut; and d) locking the at least one movable comb member on engaging a measured portion of the hair to be cut to provide a customized haircut.

In one embodiment, the method further comprises a step of texturing the length of the hair engaged between at least one movable comb and the at least one stationary comb. In another embodiment, the method further comprises a step of adjusting the at least one movable comb to change the predetermined length and inclination of hair during haircut. In one embodiment, the handle member comprises a transverse aperture along a length of the handle member for receiving user's fingers. In a related embodiment, the finger hole receives a thumb of the user while holding the handgrip to manipulate the at least one movable comb.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

DETAILED DESCRIPTION

Figure 1:
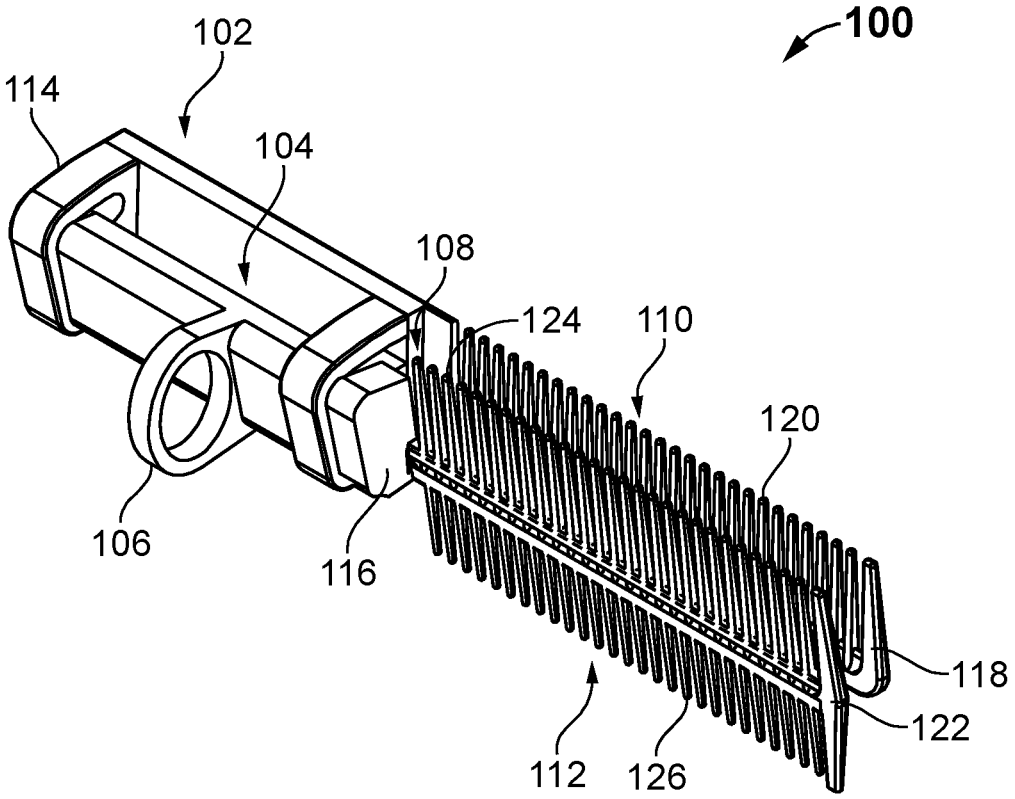
FIG. 1 shows a front perspective view of a haircutting aid, according to one embodiment of the present invention.

The present invention generally relates to a haircutting aid, and more particularly relates to a haircutting aid adapted to measure a predetermined length and inclination of hair and firmly hold the specific measured portion of hair for precise haircut.

A description of embodiments of the present invention will now be given with reference to the figures. It is expected that the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

Referring to FIG. 1-4, a haircutting aid 100 that allows a user to execute a perfect haircut without applying a haircuts technique, according to one embodiment of the present invention, is disclosed. The haircutting aid 100 is adapted to measure a predetermined length and inclination of hair and firmly hold the specific measured portion of hair for precise haircut. The haircutting aid 100 comprises a handle member 102, and a comb assembly. The comb assembly includes at least three combs (108, 110, 112) that are connected to one another in different position as is explained below in greater detail. The handle member 102 includes a first end 114 and a second end 116 spaced from the first end 114.

Referring to FIG. 1, the comb assembly comprises a first comb or at least one stationary comb 108 fixedly disposed at a second end 116 of the handle member 102 including a first elongated body 122 and a plurality of first teeth 124 projecting from the first elongated body 122 in a common direction. The handle member 102 is dimensioned to receive user's four fingers to wrap in one direction and the thumb in another direction.

Figure 2:
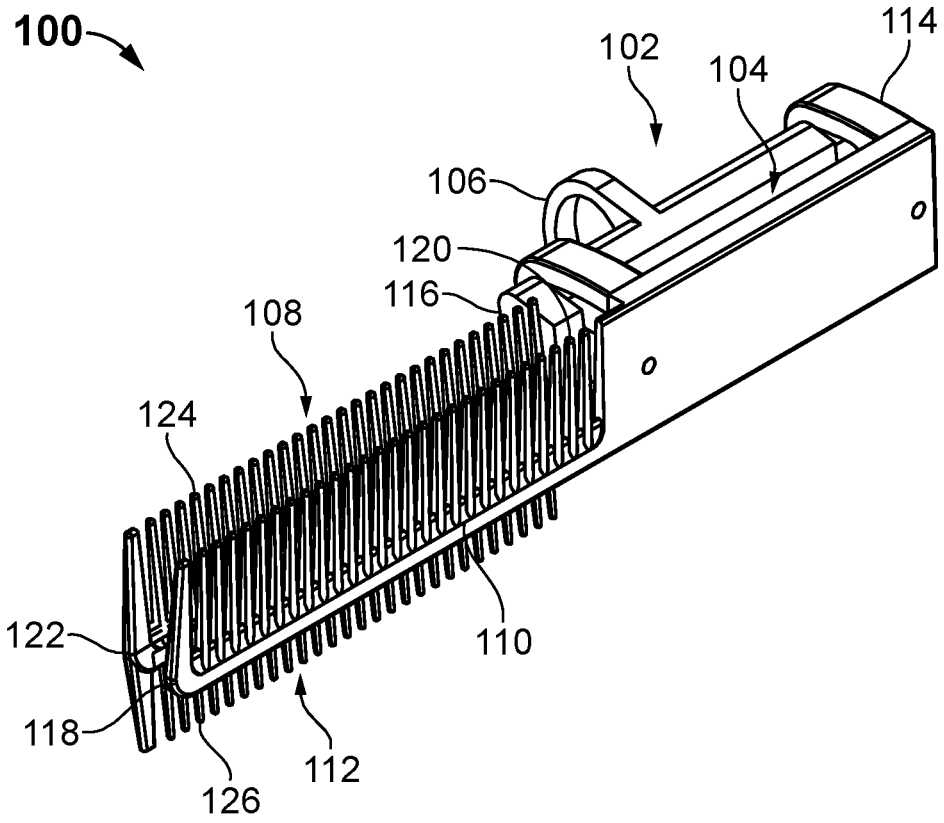
FIG. 2 shows rear perspective view of a haircutting aid, according to one embodiment of the present invention.

Referring to FIG. 2, the comb assembly further comprises a second comb or at least one movable comb 110 movably disposed at the first end 114 of the handle member 102. The second comb 110 including a second elongated body 118 and a plurality of second teeth projecting 120 from the second elongated body 118 in the common direction. The second comb 110 is disposed parallel to the first comb 108.

One aspect of the present disclosure is directed to a haircutting aid. The haircutting aid comprises an elongated handle member, the elongated handle member including a first end and a second end spaced from the first end. The haircutting aid may further comprises a comb assembly secured to the elongated handle member and comprises a first comb fixedly disposed at the second end of the handle member including a first elongated body and a plurality of first teeth projecting from the first elongated body in a common direction, and a second comb movably disposed at the first end of the handle member including a second elongated body and a plurality of second teeth projecting from the second elongated body in the common direction, said second comb is disposed parallel to the first comb.

The comb assembly may further comprise a third comb disposed rear perpendicular to the first elongated body including a plurality of third teeth projecting in a common direction. The haircutting aid may further comprise a control member extending proximal to the second end of the handle for selective movement of the second comb relative to the first comb to engage and measure a predetermined length and inclination of hair. The handle member may comprise a switch to lock the second comb on engaging the length of the hair. The handle member may include a transverse aperture along a length of the handle member for receiving user's fingers. The control member may be a finger hole for receiving a thumb of the user. The control member may be moved inwards for selective movement the second comb, and/or may be moved outwards to resume to an initial position of the second comb.

Figure 3:
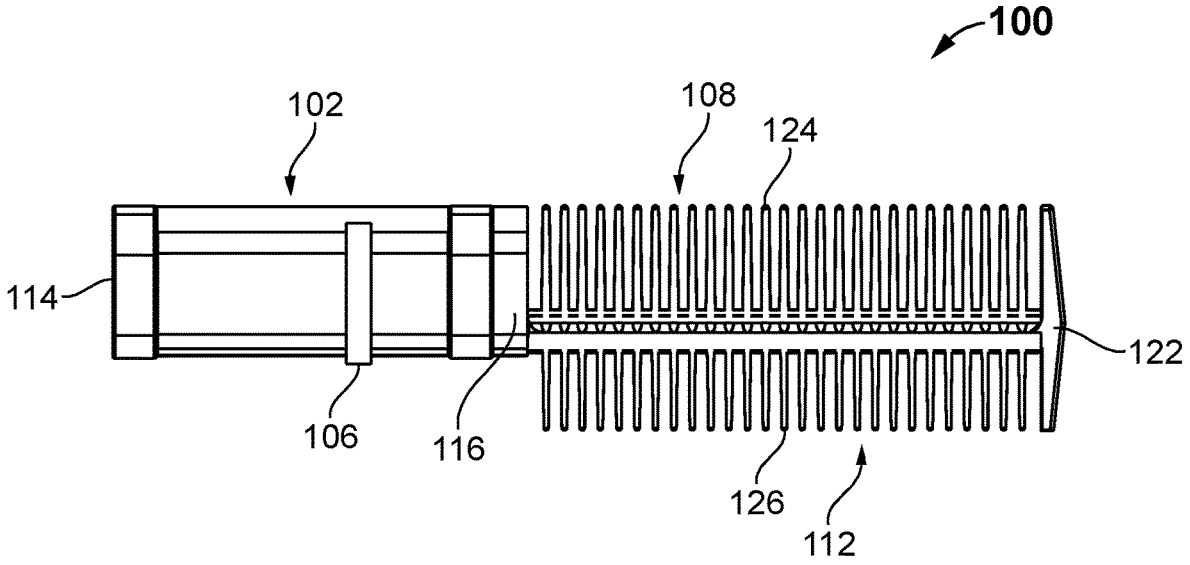
FIG. 3 shows a front view of a haircutting aid, according to one embodiment of the present invention.

Referring to FIG. 3, the comb assembly further comprises a third comb 112 is disposed at rear perpendicular to the first elongated body 122, includes a plurality of third teeth projecting 126 therefrom. In one embodiment, the first elongated body 122 comprises plurality of first teeth 124 and a plurality of third teeth 126 disposed thereon at both sides such that each first tooth 124 is 180° or at straight angle to each third tooth 126.

In one embodiment, the third comb 112 is adapted to comb the hair down. In one embodiment, the second comb 110 opens in parallel ways measuring the length from the scalp to the hair. By opening the haircutting aid 100 is divided into two parts, where one part or at least two stationary combs (108, 112) stays close to the scalp and the other part or at least one movable comb 110 provides the correct inclination for the haircut.

Referring to FIG. 1-4, the handle member 102 is an elongate rectangular member. A transverse aperture 104 is disposed there along a length of the handle member 102 for receiving the user's finger. In one embodiment, the transverse aperture 104 comprises adequate length and thickness to pass the user's four fingers through the aperture 104 in the handle member 102 and securely grasp the elongate handle member 102.

Figure 4:
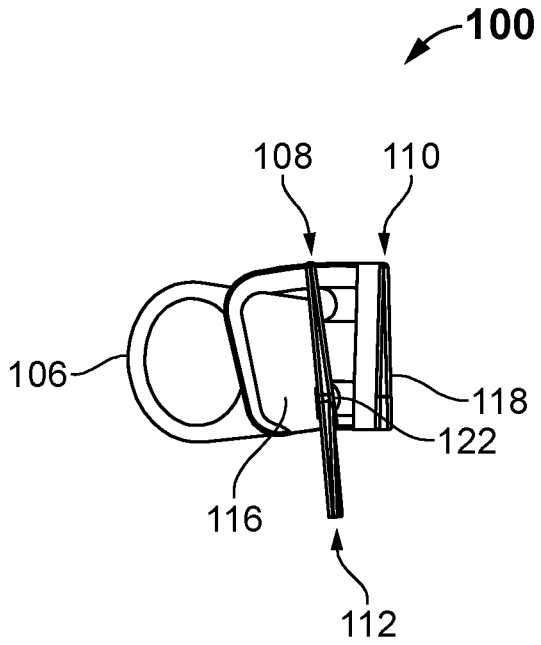
FIG. 4 shows a top view of a haircutting aid, according to one embodiment of the present invention.

A control member extends from the handle member 102, at a region proximal to the second end 116, is configured to engage and measure a predetermined length and/or inclination of hair. In one embodiment, the control member extends perpendicular to the plane of the handle member 102. In one embodiment, the control member is a finger hole or thumb hole 106 adapted to receive the thumb of the user. Referring to FIG. 4, a top view of the haircutting aid 100 is illustrated.

According to the present invention, the haircutting aid 100 further comprises a switch (not shown in figure) disposed at the handle member 102 to lock the second comb 110 on engaging the measured portion of hair. Further, the switch is configured to unlock the second comb 110 for adjusting the second comb 110 to change the predetermined length and inclination of hair during haircut, if necessary.

In one embodiment of the present invention, the haircutting aid 100 comprises a handle member 102, at least two stationary combs (108, 112) disposed at the second end 116 of the handle member 102, at least one movable comb 110 disposed parallel to at least one stationary comb 108, at the second end 116 of the handle member 102, and a control member disposed at the handle member 102 to manipulate the at least one movable comb 110 relative to the at least one stationary comb 108 to engage and measure a predetermined length and inclination of hair.

In one embodiment, a method of using the haircutting aid 100 is disclosed. At one step, the haircutting aid 100 is provided, which comprises a handle member 102 to hold the haircutting aid 100, at least two stationary combs (108, 112) disposed at the second end 116 of the handle member 102, at least one movable comb 110 disposed parallel to at least one stationary comb 108, at the second end 116 of the handle member 102, a thumb hole 106 disposed at the handle member 102 to manipulate the at least one movable comb 110 relative to the at least one stationary comb 108, allowing to engage and measure the length of a hair, and a switch to lock the at least one movable comb 110 on engaging the measured portion of the hair.

At another step, the haircutting aid 100 is held against a hair surface of the user via the handle member 102. At another step, the thumb hole 106 is manipulated inward to move the at least one movable comb 110 relative to the at least one stationary comb 108 to engage a predetermined length of the hair to be cut. At another step, the at least one movable comb 110 on engaging a predetermined length and inclination of the hair is locked.

At another step, the length of the hair engaged between at least one movable comb 110 and the at least one stationary comb 108 could be texturized or enables the user to provide a customized haircut on locking the at least one movable comb 110. At another step, the set length or inclination could be adjusted during haircut, if necessary.

In another example of the present disclosure, the haircutting aid may comprise a handle member; at least two stationary combs disposed at a proximal end of the handle member; at least one movable comb disposed parallel to at least one stationary comb, at a distal end of the handle member, and a control member disposed at the handle member to manipulate the at least one movable comb relative to the at least one stationary comb to engage and measure a predetermined length and inclination of hair. Here, the handle member may comprise a switch to lock the at least one movable comb on engaging the hair, and may comprise a transverse aperture along a length of the handle member for receiving user's fingers. The control member may be a hole for receiving a digit of the user's hands. It may be moved inwards for selectively moving the at least one movable comb. The finger hole can be moved outwards to resume to an initial position of the at least one movable comb.

According to the present invention, the haircutting aid 100 facilitates to accelerate the haircutting process, and also allows any user such as hair stylist, individual or learners to perform a haircutting technique. The haircutting aid 100 enables to texturize the hair engaged between the first comb 108 and second comb 110 and provide correct and same inclination and angle for every section of the hair need to be cut.

The haircutting aid 100 further enables to perform a move, where the stylist combs the hair and hold them with the fingers. However, the haircutting aid 100 of the present invention holds the hair straight and steady, thereby prevents repetition of the move. Further, the present invention provides confidence to cut the exact length requested by the client and safety to the user as it avoids the need of placing a finger directly in contact with the scissors.

In yet another example of the present disclosure, a method of using a unique haircutting aid is disclosed. Here, the method may comprise providing the haircutting aid comprising a handle member, at least two stationary combs disposed at a proximal end of the handle member, at least one movable comb disposed parallel to at least one stationary comb, at a distal end of the handle member, a thumb hole disposed at the handle member to manipulate the at least one movable comb relative to the at least one stationary comb, to allow the user to engage and measure a predetermined length and inclination of hair, and a switch to lock the movable comb on engaging the measured portion of hair. The method may further comprise holding the haircutting aid against hair surface of a user; and manipulating the thumb hole inward to move the at least one movable comb relative to the at least one stationary comb to engage a length and inclination of the hair to be cut; and (d) locking the at least one movable comb member on engaging a measured portion of the hair to be cut to provide a customized haircut. The method may further comprise a step of texturing the length of the hair engaged between at least one movable comb and the at least one stationary comb, and/or a step of adjusting the at least one movable comb to change the predetermined length and inclination of hair during haircut. The handle member may comprise a transverse aperture along a length of the handle member for receiving user's fingers. The finger hole may receive a thumb of the user while holding the handgrip to manipulate the at least one movable comb.

The foregoing description comprises illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions.

Although specific terms may be employed herein, they are used only in generic and descriptive sense and not for purposes of limitation. Accordingly, the present invention is not limited to the specific embodiments illustrated herein. While the above is a complete description of the preferred embodiments of the invention, various alternatives, modifications, and equivalents may be used. Therefore, the above description and the examples should not be taken as limiting the scope of the invention, which is defined by the appended claims.

The invention claimed is:

1. A haircutting aid, comprising:

an elongated handle member extending in a longitudinal direction and comprising a first member comprising a first attachment flange disposed at a proximal end of the first member and a second attachment flange disposed at a distal end of the first member, the elongated handle member further comprising a second member, movably connected to the first and second attachment flanges and spaced apart from the first member such that a transverse slot is formed between the first and second members at a location between the first and second attachment flanges, for receiving a user's fingers;

a comb assembly secured to the elongated handle member, comprising:

a first comb extending in the longitudinal direction and fixedly disposed at a distal end of the second member, the first comb including a first elongated body comprising a first surface and a second surface opposite the first surface, and a plurality of first teeth projecting from the first surface, perpendicular to longitudinal direction, and a second comb disposed at the distal end of the first member, including a second elongated body and a plurality of second teeth projecting from the second elongated body perpendicular to the longitudinal direction, said second comb is disposed parallel to and spaced apart from the first comb, and a third comb disposed on the second surface of the first elongated body including a plurality of third teeth disposed thereon perpendicularly to the longitudinal direction such that each first tooth is separated from each third tooth by 180° and projects in a common direction, and a finger hole for receiving a thumb of the user, disposed on the second member at a location between the first and second attachment flanges for selective movement of the second comb relative to the first comb to engage and measure a predetermined length and inclination of hair, wherein the finger hole is defined by a ring, projecting from the second member in a direction away from the first member.

2. A method of using a haircutting aid, comprising the step of:

providing the haircutting aid comprising:

an elongated handle member extending in a longitudinal direction and comprising a first member comprising a first attachment flange disposed at a proximal end of the first member and a second attachment flange disposed at a distal end of the first member, the elongated handle member further comprising a second member, movably connected to the first and second attachment flanges and spaced apart from the first member such that a transverse slot is formed between the first and second members at a location between the first and second attachment flanges, for receiving a users fingers;

a comb assembly secured to the elongated handle member, comprising:

a first comb extending in the longitudinal direction and fixedly disposed at a distal end of the second member, the first comb including a first elongated body comprising a first surface and a second surface opposite the first surface, and a plurality of first teeth projecting from the first surface, perpendicular to the longitudinal direction, and a second comb disposed at the distal end of the first member, including a second elongated body and a plurality of second teeth projecting from the second elongated body perpendicular to the longitudinal direction, said second comb is disposed parallel to and spaced apart from the first comb, and a third comb disposed on the second surface of the first elongated body including a plurality of third teeth disposed thereon perpendicular to the longitudinal direction such that each first tooth is separated from each third tooth by 180° and projects in a common direction, and a finger hole for receiving a thumb of the user, disposed on the second member at a location between the first and second attachment flanges for selective movement of the second comb relative to the first comb, to engage and measure a predetermined length and inclination of hair, wherein the finger hole is defined by a ring, projecting from the second member in a direction away from the first member, manipulating the thumb hole to move the second comb relative to the first comb to engage a length and inclination of the hair to be cut;

locking the second comb on engaging a measured portion of the hair to be cut to provide a customized haircut, and measuring a predetermined length and inclination of hair engaged between the second comb and the first comb; and adjusting the second comb to change the predetermined length and inclination of hair during a haircut.

* * * * *